US006005205A

United States Patent [19]

Chou

[11] Patent Number: 6,005,205

[45] Date of Patent: Dec. 21, 1999

[54] TILT SWITCH

[75] Inventor: Chin-Wen Chou, Taipei, Taiwan

[73] Assignee: Shin Jiuh Corp., Taipei Hsien, Taiwan

[21] Appl. No.: 09/178,763

[22] Filed: Oct. 26, 1998

[30] Foreign Application Priority Data

Sep. 11, 1998 [TW] Taiwan ..... 87215075

[51] Int. Cl.[6] ..... H01H 35/02

[52] U.S. Cl. ..... 200/61.45 M; 200/61.52; 200/61.45 R; 200/DIG. 29; 200/DIG. 9

[58] Field of Search ..... 200/61.52, 277, 200/52 A, DIG. 29, DIG. 9, 61.45 R, 61.45 M

[56] References Cited

U.S. PATENT DOCUMENTS

| | | | |
|---|---|---|---|
| 2,365,262 | 12/1944 | Gair . | |
| 2,997,557 | 8/1961 | Gillmore et al. . | |
| 4,486,744 | 12/1984 | Pratt et al. | 340/606 |
| 5,006,676 | 4/1991 | Bogut et al. | 200/61.52 |
| 5,252,795 | 10/1993 | Su . | |
| 5,747,762 | 5/1998 | Fukuda et al. | 200/61.45 R |

*Primary Examiner*—Michael L. Gellner
*Assistant Examiner*—Nhung Nguyen
*Attorney, Agent, or Firm*—Greenblum & Bernstein P.L.C.

[57] ABSTRACT

A tilt switch includes an insulating switch body with an inner circumferential wall that extends from a top end to a bottom end in an upright direction to define a columnar chamber. Two electrically conductive contact terminals are disposed at an annular seat at the bottom end and are spaced apart from each other in a direction transverse to the upright direction. A movable conductor member is disposed movably in the columnar chamber along the inner circumferential wall. When the switch body stands in line with the upright direction, the conductor member will abut against the annular seat to make electrical connection between the terminals. When the insulating switch body is tilted and deviates from the upright direction, the conductor member will be prompted to move away from the annular seat so as to break the electrical connection. A magnet member is disposed under the annular seat to reinforce abutment between the conductor member and the annular seat against an unexpected jerking force while the switch body stands in line with the upright direction.

6 Claims, 4 Drawing Sheets

TILT SWITCH

BACKGROUND OF THE INVENTION

1. Field of the Invention

This invention relates to a tilt switch, more particularly to a tilt switch with a magnet member adjacent to two conductive contact terminals to reinforce abutment between a movable conductor member and the conductive contact terminals.

2. Description of the Related Art

Referring to FIG. 1, a conventional safety tilt switch is shown to include an insulating switch sleeve 10 for housing a conductive steel ball 11 which is movable in the sleeve 10 along an inner circumferential wall of the sleeve 10. Two electrical conductive contact terminals 12,13 are disposed at a bottom end 101 of the sleeve 10 and are spaced apart from each other. Each terminal 12,13 is connected to a respective pin 14,15 which extends outwardly of the sleeve 10. When the switch sleeve 10 stands in line with an upright direction, gravity will bring the steel ball 11 to abut against and make electrical connection between the conductive contact terminals 12,13. When the switch sleeve 10 is tilted to deviate from the upright direction, the change of gravity center of the switch sleeve 10 will prompt the steel ball 11 to move along the inner circumferential wall so as to break the electrical connection between the terminals 12,13.

When the switch sleeve 10 stands in line with the upright direction in order to make the electrical connection between the terminals 12,13, the steel ball 11 abuts slightly against the terminals 12,13, and tends to move away from the terminals 12,13 in the event of a minor unexpected jerking force, thereby resulting in an undesired break in the electrical connection between the terminals 12,13.

SUMMARY OF THE INVENTION

The object of the present invention is to provide a tilt switch with a conductor member which can be attracted to two electrically conductive contact terminals for stabilizing the electrical connection between the conductive contact terminals.

According to this invention, a tilt switch includes an insulating switch body with a top end defining a first opening, a bottom end defining a second opening, and an inner circumferential wall which extends from the top end to the bottom end in an upright direction, and which is communicated with the first and second openings respectively so as to define a columnar chamber. An annular seat defines the second opening. Two electrically conductive contact terminals are disposed at the annular seat and are spaced apart from each other by the second opening in a direction transverse to the upright direction. A movable conductor member is disposed in the columnar chamber and is movable along the inner circumferential wall. When the insulating switch body stands in line with the upright direction, gravity will bring the conductor member to abut against the annular seat so as to make electrical connection between the conductive contact terminals. When the insulating switch body is tilted to deviate from the upright direction, a change of the gravity center of the insulating switch body will prompt the conductor member to move along the inner circumferential wall away from the annular seat so as to break the electrical connection. A magnet member is disposed under the annular seat to reinforce abutment between the conductor member and the annular seat against an unexpected jerking force while the insulating switch body stands in line with the upright direction.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
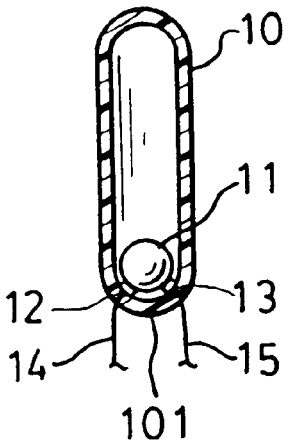
FIG. 1 PRIOR ART
FIG. 1 is a schematic view of a conventional tilt switch.

Before the present invention is described in greater detail, it should be noted that same reference numerals have been used to denote like elements throughout the specification.

Figure 2:
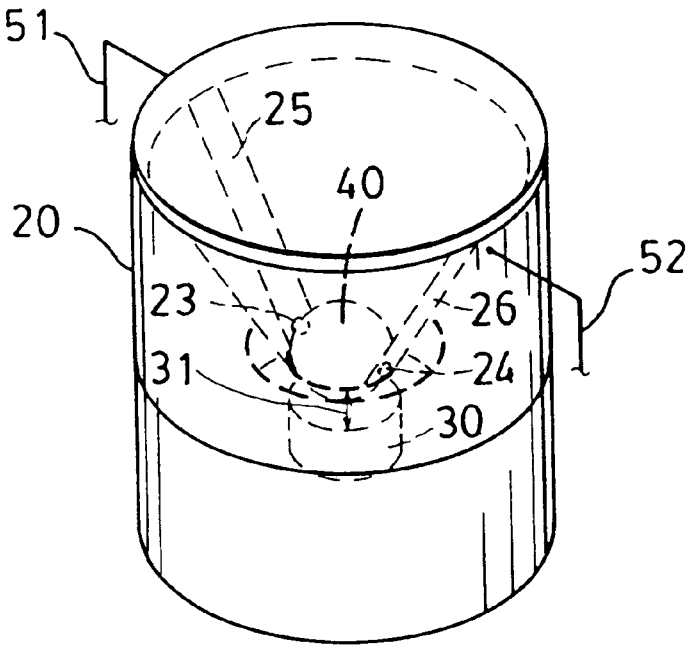
FIG. 2 is a perspective view of a first preferred embodiment of a tilt switch according to this invention.
Figure 3:
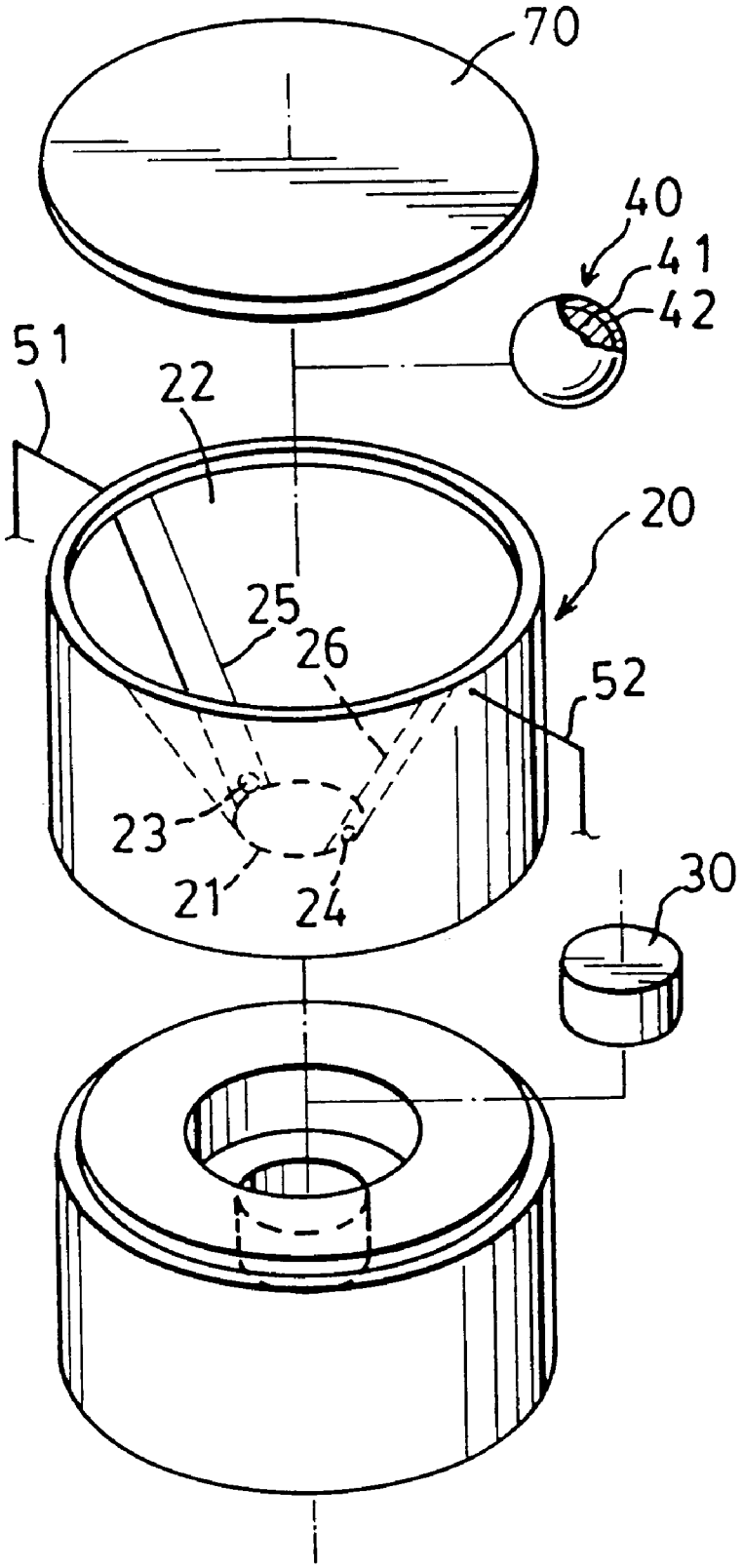
FIG. 3 is an exploded view of the first preferred embodiment.
Figure 4:
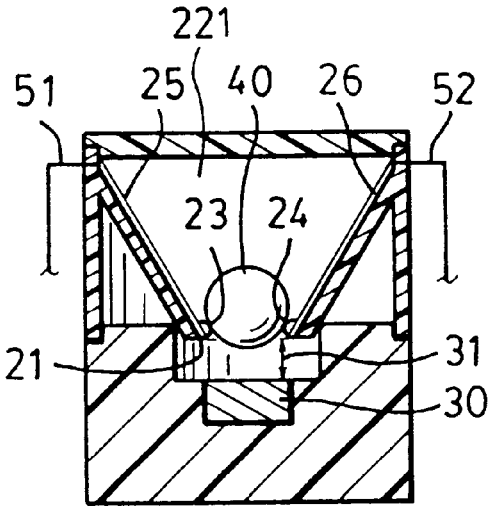
FIG. 4 is a sectional view of the first preferred embodiment.

Referring to FIGS. 2, 3 and 4, a first preferred embodiment of a tilt switch according to the present invention is shown to comprise an insulating switch body 20, two electrically conductive contact terminals 23,24, a movable conductor member 40, a magnet member 30, and a cover 70.

The insulating switch body 10 has an annular top end which defines a first opening with a first dimension, a bottom end with an annular bottom plate 21 which forms an annular seat 211 to define a second opening with a second dimension, and an inner circumferential wall 22 which extends from the top end to the bottom plate 21 in an upright direction and which is communicated with the first and second openings respectively so as to define a columnar chamber 221 between the top end and the bottom plate 21. The second dimension is smaller than the first dimension, and the inner circumferential wall 22 extends vertically from the top end to the bottom plate 21.

The conductive contact terminals 23,24 are disposed at the annular seat 211 and are spaced apart from each other by the second opening in a direction transverse to the upright direction. The conductive contact terminals 23,24 can be two conductive protrusions or two elongate conductive plates.

Figure 5:
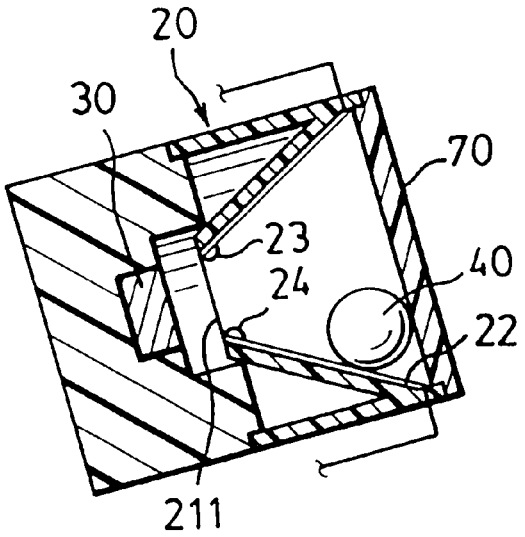
FIG. 5 is a sectional view of the first preferred embodiment in a tilted state.

The movable conductor member 40 is made of a magnetically attractive material 41 with an electrically conductive coating 42. Preferably, the magnetically attractive material 41 is made of steel or iron, and the coating 42 is made of copper or silver and is electroplated on the magnetically attractive material 41. The conductor member 40 is generally ball-shaped and is disposed in the columnar chamber 221 so as to be movable along the inner circumferential wall 22. Therefore, when the switch body 20 stands in line with the upright direction (as shown in FIG. 4), gravity will bring the conductor member 40 to abut against the annular seat 211 and make electrical connection between the conductive contact terminals 23,24. With reference to FIG. 5, when the switch body 20 is tilted and deviates from the upright direction, the change of gravity center of the switch body 20 will prompt the conductor member 40 to move along the inner circumferential wall 21 away from the annular seat 211 so as to break the electrical connection between the conductive contact terminal 23,24.

The magnet member 30 is disposed under the annular seat 211 at a predetermined distance 31 to reinforce the abutment between the conductor member 40 and the annular seat 211 against an unexpected jerking force while the switch body 20 stands in line with the upright direction.

The cover 70 is disposed on the top end of the switch body 20 to close the first opening so as to prevent removal of the conductor member 40 from the columnar chamber 221.

Two pins 51,52 have proximate ends which are connected to the conductive contact terminals 23,24 by two conductive plates 25,26, respectively, and distal ends which extend outwardly of the switch body 20. The conductive plates 25,26 are attached on the inner circumferential wall 22. Alternatively, referring to FIG. 6, the pins 51',52' can be connected directly to the conductive contact terminals 23,24.

Figure 6:
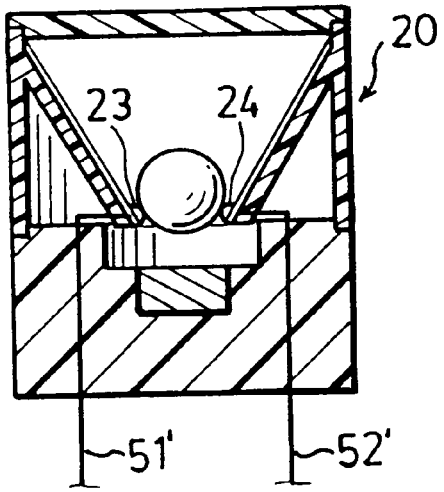
FIG. 6 is a sectional view of a second preferred embodiment of the tilt switch according to this invention.
Figure 7:
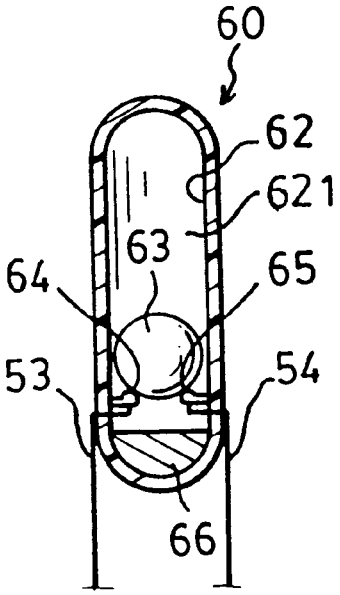
FIG. 7 is a sectional view of a third preferred embodiment of the tilt switch according to this invention.

Referring to FIG. 7, another preferred embodiment of the tilt switch according to this invention is shown to have components which are in common with those shown in FIGS. 4 and 6. The inner circumferential wall 62 of the insulating switch body 60 extends vertically from a top end to the bottom end of the switch body 60 to confine a columnar chamber 621. A ball-shaped conductor member 63 is disposed in the columnar chamber 621 and is movable along the inner circumferential wall 62 so as to abut against an annular seat at the bottom end and make electrical connection between two conductive contact terminals 64,65. The conductive contact terminals 64,65 are connected to two pins 53,54 which extend outwardly of the switch body 60. A magnet member 66 is disposed under the annular seat at a predetermined distance. In this embodiment, the switch body 60 should be tilted to deviate by a relatively larger angle from the upright direction as compared to the first and second embodiments to cause a force component of the gravity pull on the conductor member 63 to prompt the conductor member 63 to move away from the annular seat for breaking electrical connection between the conductive contact terminals 64,65. Therefore, the sensitivity of the tilt switch can be set according to the slope of the inner circumferential wall of the switch body.

As illustrated, by virtue of the magnet member 30,66, when the switch body 20,60 stands in line with the upright direction to make electrical connection between the conductive contact terminals 23,24 and 64,65, the contact force of the conductor member 40,63 with the annular seat 211 can be reinforced against an unexpected minor jerking force, thereby stabilizing the electrical connection between the conductive contact terminals 23,24 and 64,65. In addition, the magnet member 30,66 can be a permanent magnet or an electromagnet.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

I claim:

1. A tilt switch comprising:

an insulating switch body having a top end that defines a first opening with a first dimension;

a bottom end that defines a second opening with a second dimension; and an inner circumferential wall that extends from said top end to said bottom end in an upright direction, that is communicated with said first and second openings respectively so as to define a columnar chamber between said top and bottom ends, and that forms an annular seat to define said second opening;

two electrically conductive contact terminals disposed at said annular seat and spaced apart from each other by said second opening in a direction transverse to said upright direction;

a movable conductor member disposed in said columnar chamber and movable along said inner circumferential wall, and of a dimension such that when said insulating switch body stands in line with said upright direction, gravity will bring said movable conductor member to abut against said annular seat and make electrical connection between said conductive contact terminals, and such that when said insulating switch body is tilted to deviate from said upright direction, change of gravity center of said insulating switch body will prompt said movable conductor member to move along said inner circumferential wall away from said annular seat so as to break the electrical connection between said conductive contact terminals; and a magnet member disposed under said annular seat to reinforce abutment between said movable conductor member and said annular seat against an unexpected jerking force while said insulating switch body stands in line with said upright direction.

2. The tilt switch as claimed in claim 1, wherein said second dimension is smaller than said first dimension, and said inner circumferential wall converges substantially from said top end to said bottom end.

3. The tilt switch as claimed in claim 2, further comprising a cover disposed on said top end to close said first opening.

4. The tilt switch as claimed in claim 1, wherein said first dimension is similar to said second dimension, and said inner circumferential wall extends vertically from said top end to said bottom end.

5. The tilt switch as claimed in claim 1, wherein said movable conductor member is a conductive ball.

6. The tilt switch as claimed in claim 1, wherein said magnet member is a permanent magnet.

* * * * *